US011143204B2

(12) United States Patent
Park et al.

(10) Patent No.: US 11,143,204 B2
(45) Date of Patent: Oct. 12, 2021

(54) AIR COMPRESSOR

(71) Applicant: Hanon Systems, Daejeon (KR)

(72) Inventors: Chi Yong Park, Daejeon (KR); Gun Woong Park, Daejeon (KR); Hyun Sup Yang, Daejeon (KR)

(73) Assignee: Hanon Systems, Daejeon (KR)

( * ) Notice: Subject to any disclaimer, the term of this patent is extended or adjusted under 35 U.S.C. 154(b) by 58 days.

(21) Appl. No.: 16/613,017

(22) PCT Filed: May 17, 2018

(86) PCT No.: PCT/KR2018/005666

§ 371 (c)(1),
(2) Date: Nov. 12, 2019

(87) PCT Pub. No.: WO2019/004595

PCT Pub. Date: Jan. 3, 2019

(65) Prior Publication Data

US 2020/0166050 A1 May 28, 2020

(30) Foreign Application Priority Data

Jun. 30, 2017 (KR) ..... 10-2017-0083329

(51) Int. Cl.
*F04D 29/58* (2006.01)
*F04D 17/10* (2006.01)
(Continued)

(52) U.S. Cl.
CPC ..... *F04D 29/582* (2013.01); *F04D 17/10* (2013.01); *F04D 25/024* (2013.01);
(Continued)

(58) Field of Classification Search
None
See application file for complete search history.

(56) References Cited

U.S. PATENT DOCUMENTS 6,779,515 B2 * 8/2004 Vaught ..... F04D 29/5826 123/563
10,069,154 B2 * 9/2018 Metz ..... F04D 25/0606
2008/0168796 A1 7/2008 Masoudipour et al.

FOREIGN PATENT DOCUMENTS

DE 102010064061 A1 * 8/2011 ..... F02C 6/12
JP 2002064956 A * 2/2002
(Continued)

OTHER PUBLICATIONS

International Search Report issued in PCT/KR2018/005666 dated Sep. 18, 2018.

*Primary Examiner* — Juan G Flores
(74) *Attorney, Agent, or Firm* — Norton Rose Fulbright US LLP; James R. Crawford

(57) ABSTRACT

Disclosed herein is an air compressor. The air compressor may include: a compressor unit including a front housing having a front inlet and a compressor scroll, and a compressor impeller configured to transfer the air drawn through the front inlet toward the compressor scroll; a motor unit including a motor housing coupled with the front housing, a stator disposed along an inner circumferential surface of the motor housing, and a rotor disposed to pass through the stator and coupled with the compressor impeller by a rotating shaft; a turbine unit including a rear housing coupled with the motor housing, a turbine impeller coupled with the rotating shaft, and a turbine blower formed in the rear housing and configured to exhaust air that has passed through the turbine impeller to the outside; and an air cooling unit coupled with the compressor scroll to cool the stator and the rotating shaft.

13 Claims, 3 Drawing Sheets

(51) Int. Cl.
*F04D 29/056* (2006.01)
*F04D 29/42* (2006.01)
*F04D 25/02* (2006.01)

(52) U.S. Cl.
CPC ..... *F04D 29/056* (2013.01); *F04D 29/4206* (2013.01); *F04D 29/5806* (2013.01)

(56) References Cited

FOREIGN PATENT DOCUMENTS

| | | | | |
|---|---|---|---|---|
| JP | 2002064956 | A | | 2/2002 |
| KR | 20100033857 | A | * | 3/2010 |
| KR | 20100033857 | A | | 3/2010 |
| KR | 100962903 | B1 | | 6/2010 |
| KR | 20160014376 | A | | 2/2016 |
| KR | 20170058082 | A | * | 5/2017 |
| KR | 20170058082 | A | | 5/2017 |
| KR | 20170061507 | A | | 6/2017 |

* cited by examiner

AIR COMPRESSOR

This application is a national phase under 35 U.S.C. § 371 of International Application No. PCT/KR2018/005666 filed May 17, 2018, which claims the benefit of priority from Korean Patent Application No. 10-2017-0083329 filed on Jun. 30, 2017. The entire contents of each of these applications is incorporated herein by reference in its entirety.

TECHNICAL FIELD

Exemplary embodiment of the present disclosure relates to an air compressor, and more particularly, to an air compressor capable of effectively cooling a stator, a rotor, and various bearings using part of compressed air that flows through a compressor scroll.

BACKGROUND ART

Generally, a fuel cell vehicle is a vehicle in which hydrogen and oxygen are supplied to a humidifier and electrical energy generated by an electrochemical reaction which is an electrolysis reverse reaction of water is supplied as driving force of the vehicle. A typical fuel cell vehicle was proposed in Korean Patent Registration No. 0962903.

Typically, fuel cell sedans are provided with an 80-kW fuel cell stack. In the case where a fuel cell stack is operated under pressurization conditions, high-pressure air ranging from 1.2 bar to 3.0 bar is supplied to the fuel cell stack. To this end, an air compressor which is operated at a speed of 5,000 rpm to 100,000 rpm is required to be used.

Fuel cell vehicles generally include a fuel cell stack configured to generate electricity, a humidifier configured to humidify fuel and air to be supplied to the fuel cell stack, a fuel supply unit configured to supply hydrogen to the humidifier, an air supply unit configured to supply air including oxygen to the humidifier, a cooling module configured to cool the fuel cell stack, and so forth.

The air supply unit includes an air cleaner configured to filter out foreign substances included in air, an air compressor configured to compress and supply air filtered by the air cleaner, and a control box configured to control the air compressor.

The air compressor compresses, using a compressor impeller, air sucked from the outside, guides the compressed air to an outlet port using a turbine impeller, and transfers the compressed air to the fuel cell stack.

Here, the compressor impeller is coupled to a rotating shaft which receives power from a driving unit. Generally, the driving unit drives the rotating shaft by electromagnetic induction between a stator and a rotor.

Here, the stator and the rotor generate relatively high heat. Appropriate dissipation of such heat is related to extension of lifetime and maintenance period of the air compressor.

DISCLOSURE

Technical Problem

An embodiment of the present disclosure relates to an air compressor capable of effectively cooling a stator, a rotor, and various bearings using part of compressed air that flows through a compressor scroll.

Technical Solution

An air compressor in accordance with an embodiment of the present invention may include: a compressor unit including a front housing having a front inlet through which air is drawn and a compressor scroll configured to compress drawn air, and a compressor impeller disposed between the front inlet and the compressor scroll and configured to transfer the air drawn through the front inlet toward the compressor scroll; a motor unit comprising a motor housing coupled with the front housing, a stator disposed along an inner circumferential surface of the motor housing, and a rotor disposed to pass through a central portion of the stator and coupled with the compressor impeller by a rotating shaft; a turbine unit comprising a rear housing coupled with the motor housing, a turbine impeller coupled with the rotating shaft, and a turbine scroll formed in the rear housing and configured to exhaust air that has passed through the turbine impeller to an outside; and an air cooling unit coupled with the compressor scroll to receive compressed air from the compressor scroll and cool the stator and the rotating shaft.

In an embodiment of the present disclosure, the air cooling unit may include: a bypass passage coupled with the compressor scroll; a first inlet passage coupled with the bypass passage and connected with a first space in which the stator is disposed in the motor housing; and a second inlet passage coupled with the bypass passage and connected with a second space in which a thrust bearing is disposed in the motor housing.

In an embodiment of the present disclosure, the air cooling unit may include: a first outlet passage disposed in the motor housing and connected with the first space so that compressed air that has been used to cool the stator is discharged through the first outlet passage; and a second outlet passage disposed in the motor housing and connected with the second space so that compressed air that has been used to cool the rotating shaft is discharged through the second outlet passage.

In an embodiment of the present disclosure, the air cooling unit may further include a shaft hollow passage formed in central portions of the compressor impeller and the turbine impeller and disposed to pass through the rotating shaft. Air that has been discharged from the first and second outlet passages may be drawn into the shaft hollow passage through the turbine impeller to cool an interior of the rotating shaft and then discharged through the compressor impeller.

In an embodiment of the present disclosure, the air cooling unit may further include an intercooler disposed between the bypass passage and the first and second inlet passages and configured to cool compressed air drawn from the bypass passage and supply the compressed air into the first and second inlet passages.

In an embodiment of the present disclosure, the air compressor may further include a water cooling unit disposed along an outer circumference of the motor housing and configured to cool the motor unit.

In an embodiment of the present disclosure, the water cooling unit may include: a flow passage cover disposed along an outer circumference of the motor housing to enclose the motor housing; and a water cooling passage disposed along a circumferential direction in the flow passage cover.

In an embodiment of the present disclosure, the water cooling passage may have a flat shape at an inner side thereof adjacent to the motor housing and have an arch shape at an outer side thereof so as to enhance a heat dissipation rate of the motor housing.

In an embodiment of the present disclosure, the intercooler may be disposed inside the flow passage cover.

Advantageous Effects

As described above, part of compressed air flowing through a compressor scroll is bypassed and supplied toward a stator of a motor, a rotating shaft of a rotor, and various bearings, whereby components of the motor can be effectively cooled.

Thereafter, the compressed air returns from a turbine unit to a compressor unit through an internal central portion of the rotating shaft so that the compressed air can be reused.

Consequently, the cooling efficiency of compressed air can be enhanced, and the reusability of cooling air can be increased.

MODE FOR INVENTION

Hereinafter, embodiments of an air compressor according to the present disclosure will be described with reference to the attached drawings.

Figure 1:
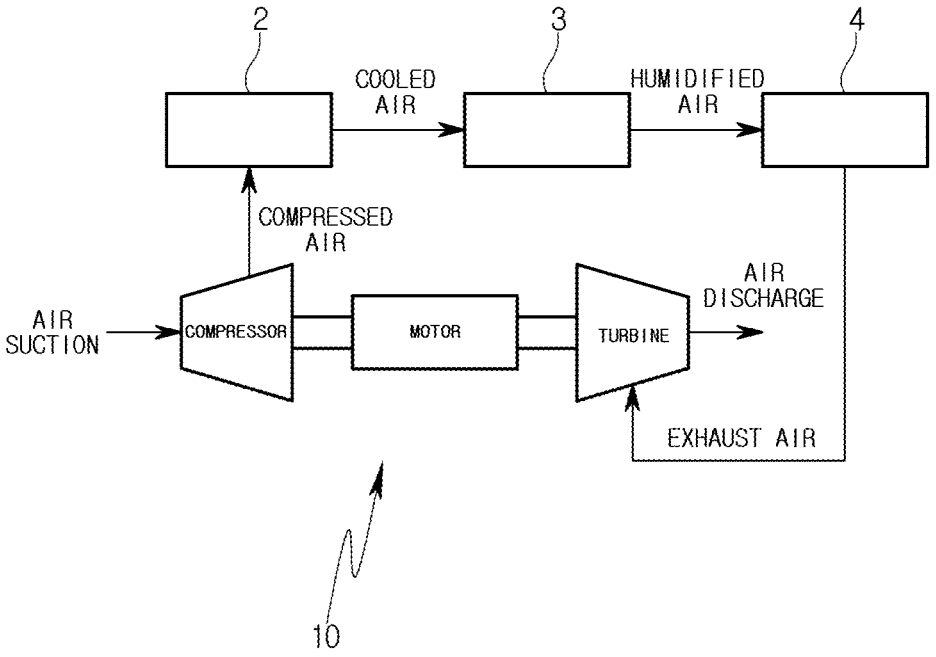
FIG. 1 is a diagram illustrating a fuel cell system in accordance with an embodiment of the present disclosure.

FIG. 1 is a diagram illustrating a fuel cell system in accordance with embodiments of the present disclosure.

Referring to FIG. 1, the fuel cell system includes an air compressor 10, a heat exchanger 2, a humidifier 3, and a fuel cell 4.

To supply air to the fuel cell 4, the air compressor 10 functions to receive external air, and compress and transfer the air to the fuel cell 4. The heat exchanger 2 functions to cool high-temperature air compressed by the air compressor 10. The humidifier 3 functions to add moisture to the cooled air. The fuel cell 4 functions to receive humidified air and generate electricity. Here, air that is supplied to the fuel cell 4 and then discharged therefrom is supplied to a turbine of the air compressor 10 to reduce a load of a driving unit of the air compressor 10 rather than being directly exhausted out of a vehicle. Thereafter, air that has passed through the turbine is exhausted out of the vehicle.

The key issue in a fuel cell vehicle is how to efficiently use electricity. In this aspect, the air compressor 10 is an apparatus having low electricity use efficiency (requiring high output and high RPM). Therefore, improvement in structure pertaining thereto is needed. Embodiments of the present disclosure propose key technologies for enhancing the electricity use efficiency of the air compressor 10.

Figure 2:
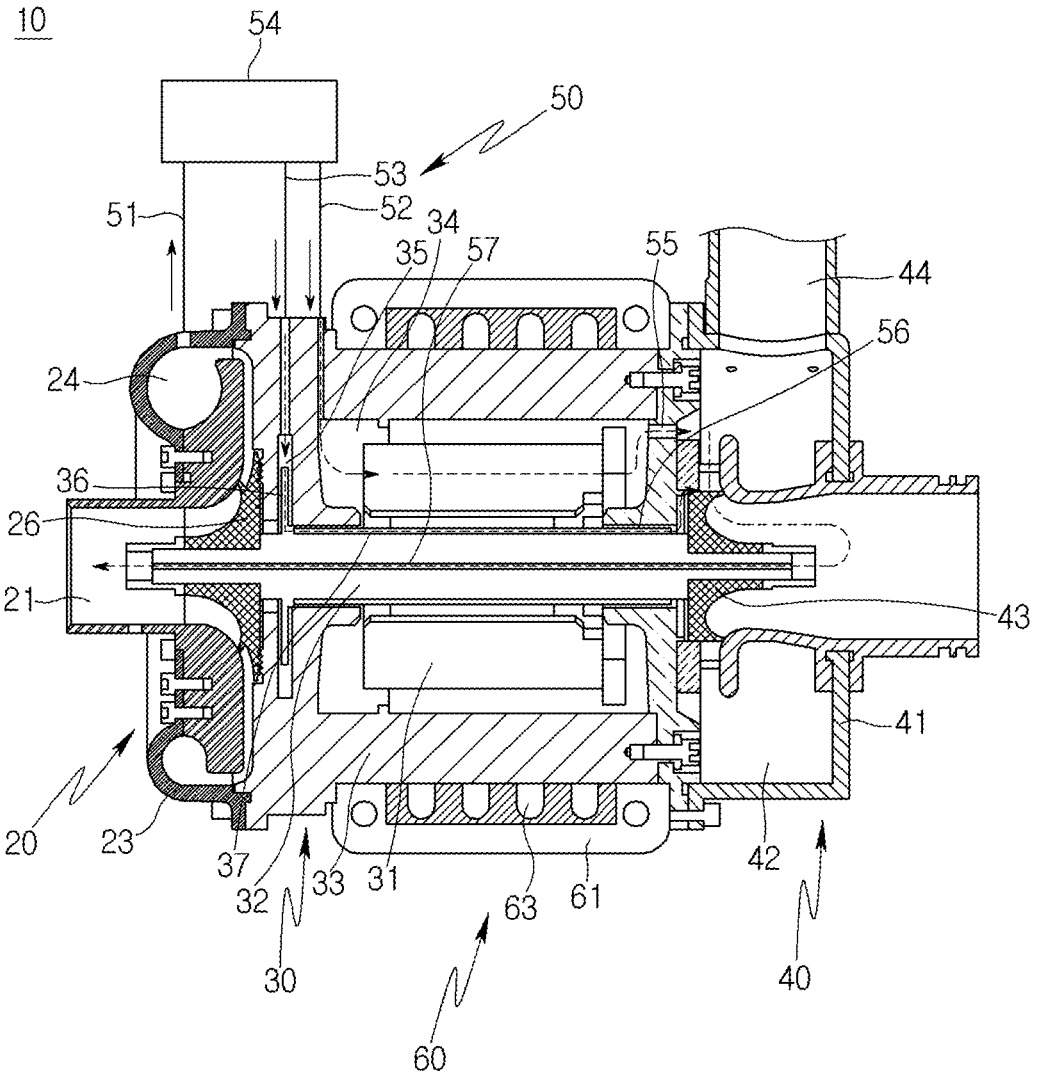
FIG. 2 is a diagram illustrating a first embodiment of an air compressor of FIG. 1.

FIG. 2 is a diagram illustrating a first embodiment of the air compressor 10 of FIG. 1.

Referring to FIG. 2, the air compressor 10 according to the present disclosure may include a compressor unit 20, a motor unit 30, a turbine unit 40, and an air cooling unit 50.

The compressor unit 20 may be a part which compresses air drawn from the outside. The compressor unit 20 may include a front inlet 21, a compressor scroll 24, a front housing 23, and a compressor impeller 26.

The front inlet 21 may be formed to pass through a central portion of the front housing 23. The front housing 23 may have an overall disk shape, the central portion of which protrudes, and may have a structure in which a plurality of parts are coupled to each other by bolting.

Here, the perimeter of the front housing 23 has a round shape which is gradually reduced in width, and forms space for the compressor scroll 24.

The compressor scroll 24 is coupled with the front inlet 21 and has a shape in which the cross-sectional area thereof is gradually reduced so that drawn air can be compressed.

The compressor impeller 26 may be disposed between the front inlet 21 and the compressor scroll 24 in the front housing 23 so as to transfer air drawn through the front inlet 21 toward the compressor scroll 24.

In the compressor unit 20, air drawn through the front inlet 21 is transferred to the compressor scroll 24 by the compressor impeller 26 and compressed in the compressor scroll 24 the cross-sectional area of which is gradually reduced, and then flows toward the turbine 40.

The motor unit 30 may be a part which transmits power to the compressor unit 20 and the turbine unit 40. The motor unit 30 may include a motor housing 33, a stator 31, a rotor 32, a thrust bearing 36, and a journal bearing 37.

The motor housing 33 may have an overall cylindrical shape and be coupled with the front housing 23 by bolting.

The stator 31 may be disposed in a circumferential direction along an inner circumferential surface of the motor housing 33. The rotor 32 may be disposed at the center of the stator 31. The rotor 32 may include a rotating shaft that is coupled with the compressor impeller 26 and a turbine impeller 43 of the turbine unit 40.

Here, the journal bearing 37 may be disposed in the motor housing 33 at a position adjacent to an outer circumferential surface of the rotor 32 so that the rotor 32 can smoothly rotate in the motor housing 33.

The thrust bearing 36 may be disposed at a position adjacent to space between the rotor 32 and the motor housing 33 so that frictional resistance occurring due to axial movement of the rotor 32 when operating can be reduced.

Here, in the motor housing 33, space in which the stator 31 is disposed may be designated as a first space 34, and space in which the thrust bearing 36 is disposed may be designated as a second space 35.

The turbine unit 40 may a part which discharges air supplied from the compressor unit 20 to the outside. The turbine unit 40 may include a rear housing 41, the turbine impeller 43, and a turbine scroll 42.

The rear housing 41 may be coupled to the motor housing 33 by bolting and have an overall cylindrical shape, the central portion of which protrudes.

The turbine impeller 43 coupled to the rotating shaft of the rotor 32 is disposed in a central portion of the rear housing 41 so that air supplied from the compressor unit 20 can be transferred toward the turbine scroll 42. The turbine blower 42 is coupled with an outlet 44 and sends air transferred by the turbine impeller 43 toward the outlet 44.

The air cooling unit 50 may be connected with the compressor scroll 24 so as to receive compressed air from the compressor scroll 24 and cool the rotating shaft.

The air cooling unit 50 may include a bypass passage 51, a first inlet passage 52, a second inlet passage 53, a first outlet passage 55, a second outlet passage 56, an intercooler 54, and a shaft hollow passage 57.

The bypass passage 51 may be connected with the compressor scroll 24. In the present disclosure, compressed air flowing through the compressor scroll 24 is used as cooling fluid. The temperature of the compressed air flowing through the compressor scroll 24 ranges from approximately 130° C. to approximately 150° C.

The bypass passage 51 is connected with the intercooler 54. The intercooler 54 cools compressed air drawn through the bypass passage 51 and supplies the compressed air to the first and second inlets 52 and 53. In the intercooler 54, the compressed air is cooled to a temperature ranging from approximately 70° C. to approximately 80° C.

In the first embodiment of the present disclosure, the intercooler 54 may be separately disposed outside the air compressor 10 and coupled thereto through a duct line such as a pipe.

The first inlet passage 52 is connected with the bypass passage 51 and connected with the first space 34 in which the stator 31 is disposed in the motor housing 33. The second inlet passage 53 is connected with the bypass passage 51 and connected with the second space 35 in which the thrust bearing 36 is disposed in the motor housing 33.

Compressed air that is cooled in the intercooler 54 is divided into two parts so that the two parts are respectively supplied into the first and second inlet passages 52 and 53.

The compressed air that is supplied into the first inlet passage 52 cools the stator 31 in the first space 34. Here, the compressed air flows through gaps between parts of a coil wound a plurality of times to form the stator 31 or flows through space between a plurality of coils disposed in a circumferential direction, thus cooling the stator 31.

The compressed air that is supplied into the second inlet passage 53 flows in the second space 35 from an outer edge of the thrust bearing 36, which radially protrudes from the rotating shaft of the rotor 32, toward a central portion of the thrust bearing 36, thus first cooling the thrust bearing 36. Thereafter, the compressed air flows along the outer circumferential surface of the rotor 32, thus cooling the entirety of the rotor 32.

Here, the compressed air flows through the journal bearing disposed between the motor housing 33 and the rotor 32, thus also cooling the journal bearing.

The stator 31 and the rotor 32 generate heat while being operated by electromagnetic induction, and are heated to temperatures ranging from approximately 180° C. to approximately 200° C. In this state, as compressed air having a temperature ranging from 70° C. to 80° C. is supplied, the stator 31 and the rotor 32 are generally cooled.

The first outlet passage 55 is disposed in the motor housing 33 and connected with the first space 34, and is a part through which compressed air that has been used to cool the stator 31 is discharged. The second outlet passage 56 is disposed in the motor housing 33 and connected with the second space 35, and is a part through which compressed air that has been used to cool the rotating shaft is discharged.

The parts of the compressed air that have been used to cool the stator 31 and the rotor 32 are discharged toward the turbine unit 40 through the first and second outlet passages 56 and 57, respectively.

In the turbine unit 40, compressed air flows toward the turbine impeller 43 and then flows back toward the compressor unit 20 along the interior of the rotor 32 coupled with the turbine impeller 43 by the rotating shaft.

The shaft hollow passage 57 may be formed in the central portions of the compressor impeller 26 and the turbine impeller 43 and disposed to pass through the rotating shaft. Compressed air flowing through the turbine impeller 43 flows along the shaft hollow passage 57, thus cooling the interior of the rotor 32. Here, the temperature of the compressed air is slightly increased compared to that when cooling the stator 31 and the rotor 32 in the first and second spaces 34 and 35, but is still lower than the temperature of the interior of the rotor 32.

Compressed air that has passed through the shaft hollow passage 57 is discharged again through the central portion of the compressor impeller 26, and thereafter mixed with air drawn through the front inlet 21 and then reused as compressed air.

The air compressor 10 in accordance with an embodiment of the present disclosure may further include a water cooling unit 60 which is disposed along an outer circumference of the motor housing 33 to cool the motor unit 30. The water cooling unit 60 may include a flow passage cover 61 and a water cooling passage 63.

The flow passage cover 61 may be disposed to enclose the outer circumference of the motor housing 33. The water cooling passage 63 may be disposed to be wound a plurality of times along a circumferential direction in the flow passage cover 61.

Here, the water cooling passage 63 may have a flat shape at an inner side thereof adjacent to the motor housing 33 and have an arch shape at an outer side thereof so as to enhance a heat dissipation rate of the motor housing 33. In this case, since the surface area with which the water cooling passage 63 comes into contact with the surface of the motor housing 33 is relatively increased, the heat dissipation rate by the cooling water flowing through the water cooling passage 63 may be further increased.

Figure 3:
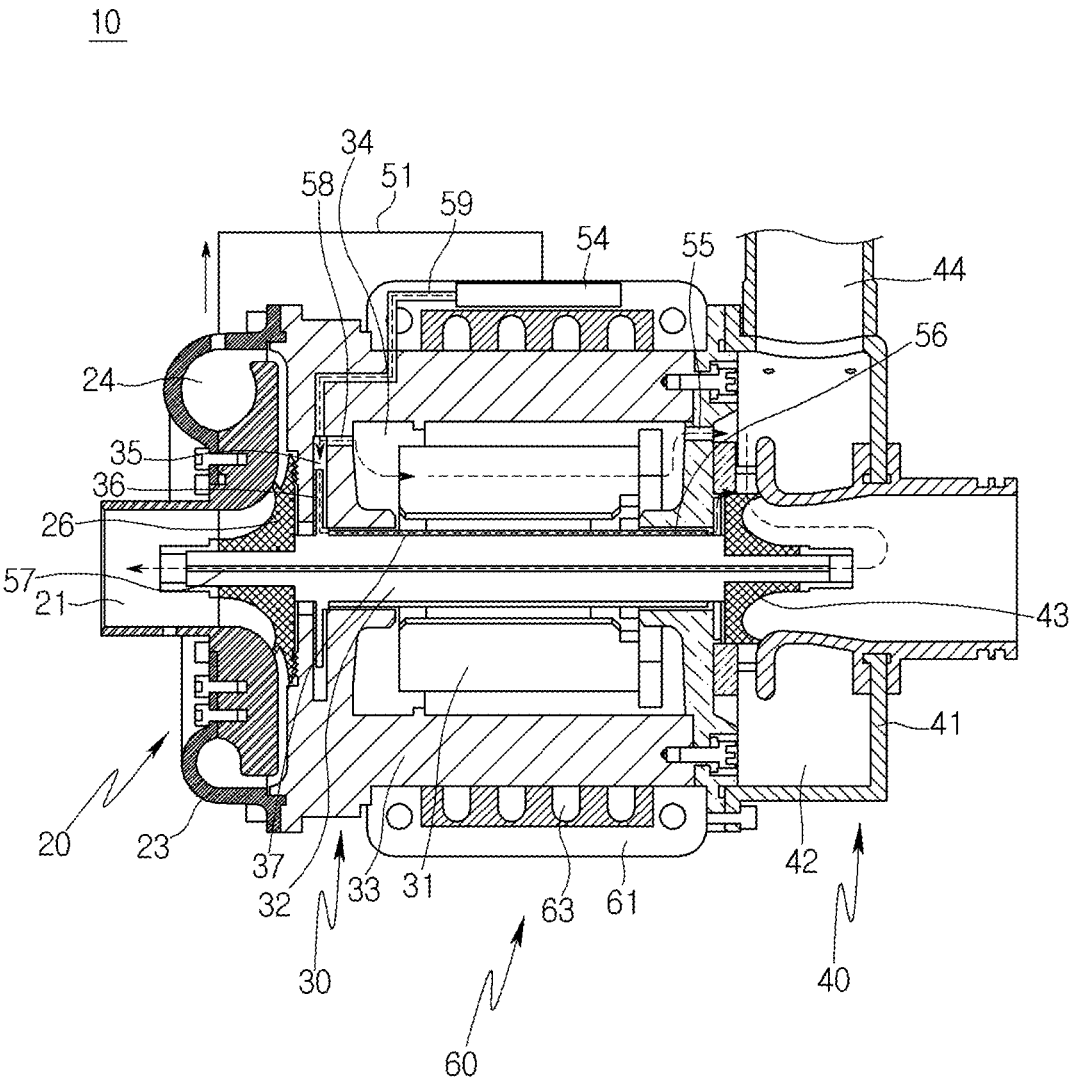
FIG. 3 is a diagram illustrating a second embodiment of the air compressor of FIG. 1.

FIG. 3 illustrates a second embodiment of the air compressor 10 in accordance with the present disclosure.

In the second embodiment of the present disclosure, the intercooler 54 may be disposed inside the flow passage cover 61.

The bypass passage 51 is coupled with the intercooler 54 by a pipe. The second space 35 is coupled with the intercooler 54 by a branch passage 59 formed in the motor housing 33.

The second space 35 is connected with the first space 34 by a plurality of branch holes 58 which are formed in the motor housing 33 at positions spaced apart from each other in a circumferential direction.

Compressed air that has been cooled in the intercooler 54 is drawn into the second space 35 and then diverges in the circumferential direction through the branch holes 58 and flows into the first space 34. Thereby, the diverged parts of the compressed air respectively cool the thrust bearing 36, the journal bearing 37, the rotor 32, and the stator 31 and then are discharged through the first and second outlet passages 55 and 56.

In the air compressor according to present disclosure having the above-mentioned configuration, heat generated from the stator 31, the rotor 32, and the various bearings 36 and 37 while the air compressor is operated may be effectively dissipated.

The above description is only for specific embodiments of the air compressor according to the present disclosure.

Therefore, it will be apparent to those skilled in the art that various changes and modifications may be made without departing from the spirit and scope of the disclosure as defined in the following claims.

INDUSTRIAL APPLICABILITY

The present disclosure relates to an air compressor.

What is claimed:

1. An air compressor comprising:

a compressor unit comprising: a front housing including a front inlet through which air is drawn, and a compressor scroll configured to compress drawn air; and a compressor impeller disposed between the front inlet and the compressor scroll and configured to transfer the air drawn through the front inlet toward the compressor scroll;

a motor unit comprising a motor housing coupled with the front housing, a stator disposed along an inner circumferential surface of the motor housing, and a rotor disposed to pass through a central portion of the stator and coupled with the compressor impeller by a rotating shaft;

a turbine unit comprising a rear housing coupled with the motor housing, a turbine impeller coupled with the rotating shaft, and a turbine scroll formed in the rear housing and configured to exhaust air that has passed through the turbine impeller to an outside; and an air cooling unit coupled with the compressor scroll to receive compressed air from the compressor scroll and cool the stator and the rotating shaft; and wherein the air cooling unit comprises:

a bypass passage coupled with the compressor scroll;

a first inlet passage coupled with the bypass passage and connected with a first space in which the stator is disposed in the motor housing; and a second inlet passage coupled with the bypass passage and connected with a second space in which a thrust bearing is disposed in the motor housing; and the first inlet passage and the second inlet passage are separated from each other in the motor housing, so compressed air flows separately into the first space and the second space, respectively.

2. The air compressor of claim 1, wherein the air cooling unit comprises:

a first outlet passage disposed in the motor housing and connected with the first space so that compressed air that has been used to cool the stator is discharged through the first outlet passage; and a second outlet passage disposed in the motor housing and connected with the second space so that compressed air that has been used to cool the rotating shaft is discharged through the second outlet passage.

3. The air compressor of claim 2, wherein the air cooling unit further comprises a shaft hollow passage formed in central portions of the compressor impeller and the turbine impeller and disposed to pass through the rotating shaft, wherein air that has been discharged from the first and second outlet passages is drawn into the shaft hollow passage through the turbine impeller to cool an interior of the rotating shaft and then discharged through the compressor impeller.

4. The air compressor of claim 3, wherein the air cooling unit further comprises an intercooler disposed between the bypass passage and the first and second inlet passages and configured to cool compressed air drawn from the bypass passage and supply the compressed air into the first and second inlet passages.

5. The air compressor of claim 4, further comprising a water cooling unit disposed along an outer circumference of the motor housing and configured to cool the motor unit.

6. The air compressor of claim 4, further comprising a water cooling unit comprising: a flow passage cover disposed along an outer circumference of the motor housing to enclose the motor housing; and a water cooling passage disposed along a circumferential direction in the flow passage cover.

7. The air compressor of claim 6, wherein the water cooling passage has a flat shape at an inner side thereof adjacent to the motor housing and has an arch shape at an outer side thereof so as to enhance a heat dissipation rate of the motor housing.

8. The air compressor of claim 6, wherein the intercooler is disposed inside the flow passage cover.

9. The air compressor of claim 2, wherein the air cooling unit further comprises an intercooler disposed between the bypass passage and the first and second inlet passages and configured to cool compressed air drawn from the bypass passage and supply the compressed air into the first and second inlet passages.

10. The air compressor of claim 9, further comprising a water cooling unit disposed along an outer circumference of the motor housing and configured to cool the motor unit.

11. The air compressor of claim 9, further comprising a water cooling unit comprising:

a flow passage cover disposed along an outer circumference of the motor housing to enclose the motor housing; and a water cooling passage disposed along a circumferential direction in the flow passage cover.

12. The air compressor of claim 11, wherein the water cooling passage has a flat shape at an inner side thereof adjacent to the motor housing and has an arch shape at an outer side thereof so as to enhance a heat dissipation rate of the motor housing.

13. The air compressor of claim 11, wherein the intercooler is disposed inside the flow passage cover.

* * * * *